United States Patent [19]

Goodman

[11] Patent Number: 4,742,812

[45] Date of Patent: May 10, 1988

[54] PISTOL CROSSBOW ASSEMBLY

[75] Inventor: Bernard Goodman, Mahwah, N.J.

[73] Assignee: Largo Toys, Ltd., New York, N.Y.

[21] Appl. No.: 934,184

[22] Filed: Nov. 24, 1986

[51] Int. Cl.[4] ..... F41B 5/00

[52] U.S. Cl. ..... 124/25

[58] Field of Search ..... 124/25, 20 B, 21, 22

[56] References Cited

U.S. PATENT DOCUMENTS

| | | | |
|---|---|---|---|
| 537,817 | 4/1895 | Coates | 124/25 |
| 1,192,639 | 7/1916 | Hunholz | 124/25 |
| 1,329,734 | 2/1920 | White | 124/25 |
| 1,375,990 | 4/1921 | Yorgensen | 124/25 |
| 2,736,461 | 3/1957 | Pelsue, Jr. | 124/25 |
| 2,842,114 | 7/1958 | Duncan | 124/25 |
| 3,224,427 | 12/1965 | Ronan | 124/25 |
| 3,968,783 | 7/1976 | Pfotenhauer | 124/25 |
| 4,002,236 | 1/1977 | Tolleson | 124/25 |
| 4,294,222 | 10/1981 | Pelsue | 124/25 |
| 4,480,774 | 11/1984 | Smith et al. | 124/25 |

FOREIGN PATENT DOCUMENTS

| | | | |
|---|---|---|---|
| 1112909 | 11/1955 | France | 124/21 |

*Primary Examiner*—Richard C. Pinkham
*Assistant Examiner*—Benjamin Layno
*Attorney, Agent, or Firm*—Gottlieb, Rackman & Reisman

[57] ABSTRACT

A pistol crossbow assembly is provided in which the bow is rotatably connected to the nose area of the gun so that it can lay substantially parallel to the plane of the gun when packaged. The assembly includes a gun having a frame, handle and trigger portion and a crossbow having a bow and string. Forwardly extending from the frame is the nose or barrel of the gun. In manufacture, the bow is pivotably connected to the nose or barrel so that it can rotate when a rotational force is applied thereto.

9 Claims, 3 Drawing Sheets

FIG. 1
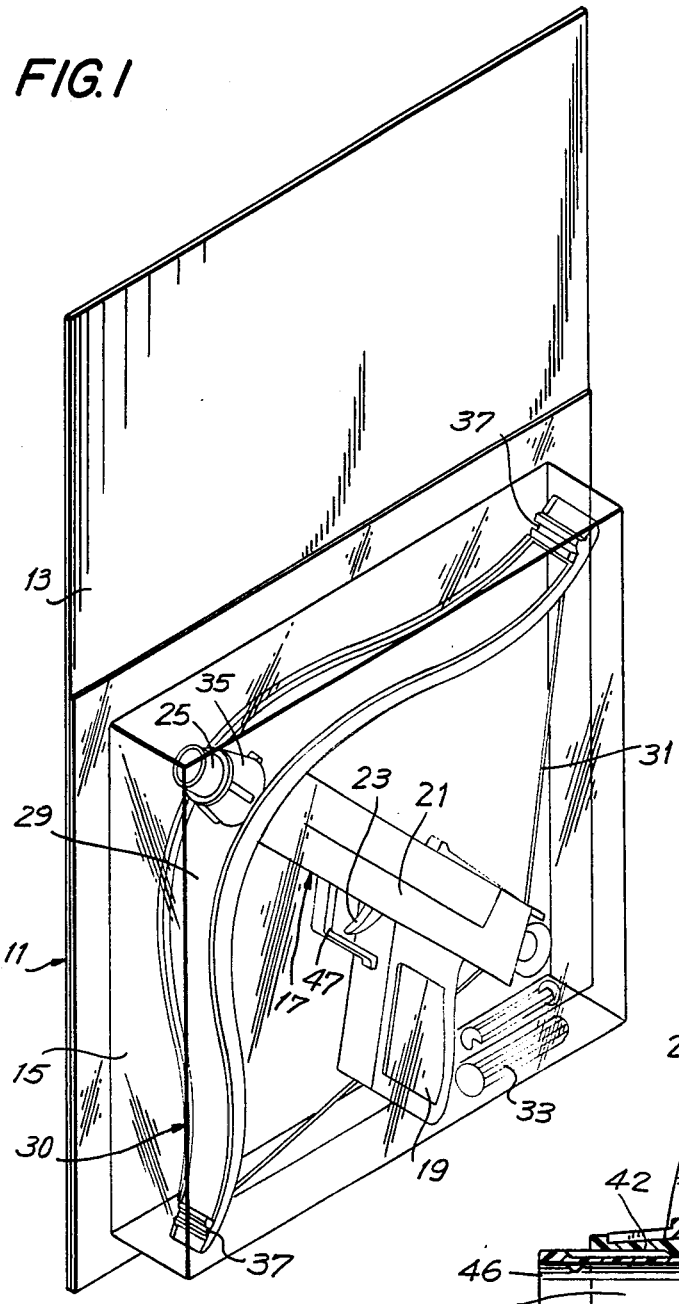
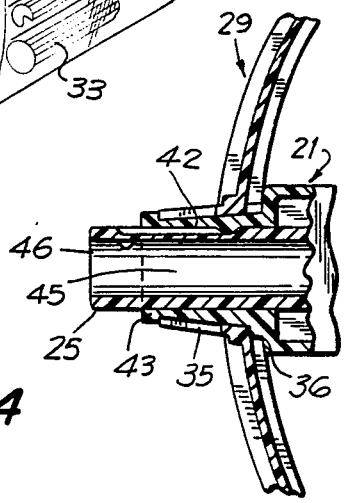
FIG. 4

PISTOL CROSSBOW ASSEMBLY

BACKGROUND OF THE INVENTION

This invention relates generally to the field of toy guns and crossbows, and more particularly to a pistol crossbow assembly that includes a bow which is pivotably connected to the nose area of a gun in order that it can rotate and lay substantially parallel to the plane of the gun when packaged.

Toy gun assemblies which include a gun member and a crossbow member connected thereto have become popular as toys for both children and adults alike. This is because of the novel feature of combining a toy gun with a toy bow in one single device.

The crossbow assembly is often packaged completely assembled to enable the user to operate the toy without having to first determine how to attach the various components. However, if the device is packaged fully assembled, it may take up a large amount of space, thus requiring a large and bulky packaging vehicle.

In order to reduce the size and bulkiness of the assembly when packaged, it has been suggested to use a hinge mechanism when connecting the bow to the gun. With such a construction, the bow may be pivoted relative to the gun at the hinge so that it can lay parallel to the longitudinal axis of the barrel of the gun. This substantially reduces the space occupied by the assembly.

However, this type of construction is not completely satisfactory. Since a hinge mechanism is involved, the gun assembly is susceptible to breakage when pivoting the bow from an inoperative position to an operative position.

Accordingly, it is desirable to provide a pistol crossbow assembly which has a reduced packaging size, but which is not susceptible to breakage when the bow is pivoted from an inoperative position to an operative position.

SUMMARY OF THE INVENTION

Generally speaking, in accordance with the invention, a pistol crossbow assembly is provided in which the bow is rotatably connected to the nose area of the gun so that it can lay substantially parallel to the plane of the gun when packaged. The assembly includes a gun having a frame, handle and trigger portion and a crossbow having a bow and string. Forwardly extending from the frame is the nose or barrel of the gun. In manufacture, the bow is pivotably connected to the nose or barrel so that it can rotate when a rotational force is applied thereto.

When using the assembly, the bow is perpendicular to the plane of the gun when in an operational (firing) position. Due to the rotatability of the bow, the assembly can be oriented such that the bow lays substantially parallel to the plane of the gun, whereby the assembly can be placed into a quite flat package.

The particular advantage of the assembly is that it can be sold fully assembled in packaging which is not overly bulky, due to the easy rotatability of the bow from its "packaged" position to its operative position.

Accordingly, it is an object of the invention to provide a pistol crossbow assembly in which the bow is rotatably connected to the nose portion of the gun.

Another object of the invention is to provide a pistol crossbow assembly that can be sold fully assembled, in a flat package.

Still a further object of the invention is to provide a pistol crossbow assembly which can be sold in packaging of a reduced size.

Yet another object of the invention is to provide a piston crossbow assembly in which the bow is not easily damaged when placed in an operating position.

Still other objects and advantages of the invention will in part, be obvious and will, in part, be apparent from the preceding description.

The invention accordingly comprises an article of manufacture possessing the features, properties, and the relation of elements which will be exemplified in the device hereinafter described, and the scope of the invention will be indicated in the claims.

BRIEF DESCRIPTION OF THE DRAWINGS

For a fuller understanding of the invention, reference is made to the following description taken in connection with the accompanying drawings in which:

FIG. 1 is a perspective view showing the pistol crossbow assembly of the invention positioned in a package;

FIG. 4 is also a cross-sectional view taken along line 4—4 of FIG. 2.

DETAILED DESCRIPTION OF PREFERRED EMBODIMENT

Figure 2:
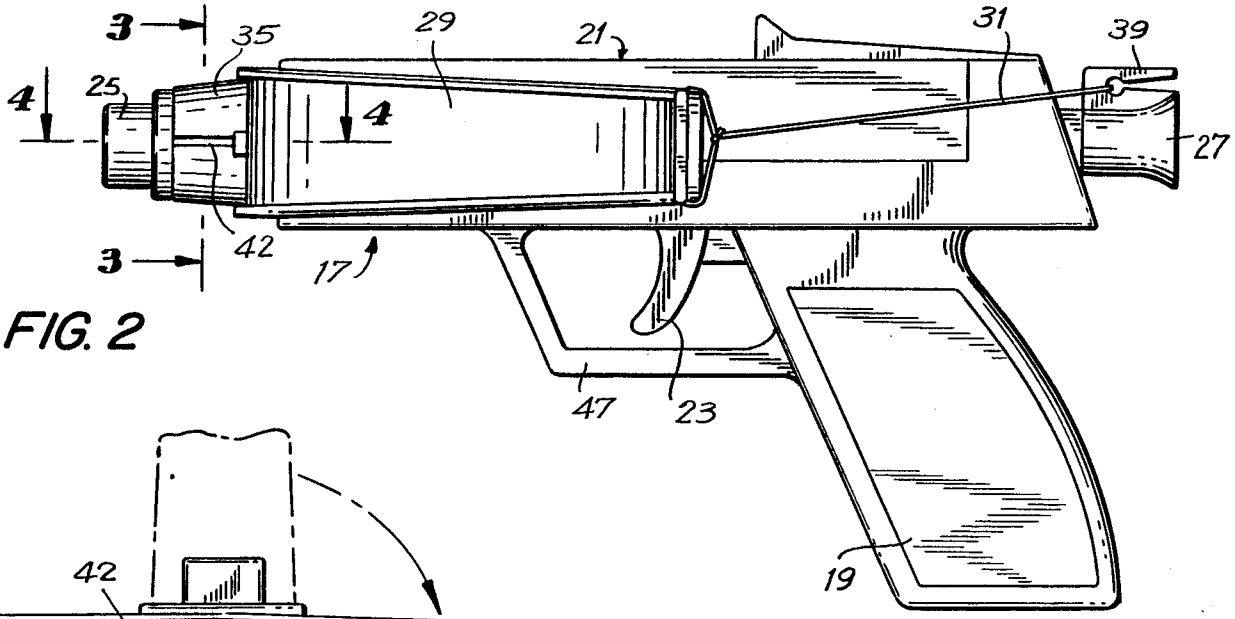
FIG. 2 is a side elevational view of the pistol crossbow assembly shown in FIG. 1.

Referring first to FIGS. 1 and 2, a pistol crossbow assembly in accordance with the invention is shown, and comprises a gun 17 and a crossbow 30. Gun 17 includes a frame 21, a cocking member 27 disposed rearwardly of frame 21, a handle 19, a trigger 23 and a trigger guard 47 integrally formed with frame 21 and handle 19. Forwardly extending from frame 21, as shown best in FIG. 4, is nose portion 42, which is substantially cylindrical in shape and is provided with a circumferential flange 43 at its tip.

Figure 5:
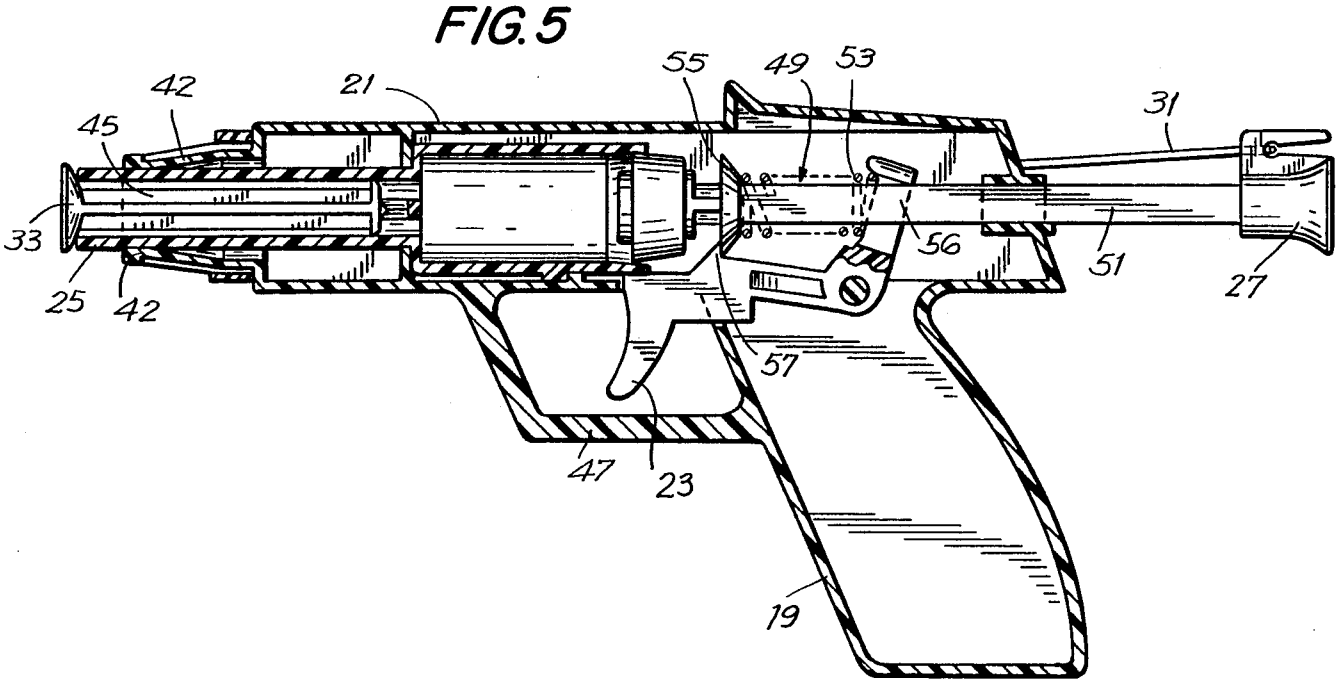
FIG. 5 is a cross-sectional view of the pistol crossbow assembly showing the interior of the pistol.

Gun 17, as shown in FIGS. 4 and 5, as well as in FIGS. 1 and 2, also includes a barrel 25 extending longitudinally through frame 21 and nose portion 42, and protruding beyond flange 43. Barrel 25 is formed with a cylindrical ejection channel 45, which includes a forwardly extending open end 46 for receiving a toy dart 33. At its rearward end, barrel 25 is provided with a spring means, generally designated at 49, which is operatively connected to trigger 23 and cocking member 27, as described below.

As show in FIG. 5, spring means 49 of gun 17 comprises a cocking rod 51 forwardly extending from cocking member 27, and a helical spring 53 disposed about the forward portion of rod 51. Rod 51 includes a disc member 55 integrally formed therewith and forwardly extending from spring 53.

Also as shown in FIG. 5, trigger 23 of gun 17 is integrally formed with a catch member 57 and a stop arm 56. When cocking member 27 is retracted in order to place gun 17 in a ready-to-fire condition, cocking rod 51 is pulled rearwardly, thereby compressing spring 53 against arm 56. Retraction continues until disc member 55 of cocking rod 51 is caught by catch member 57.

As shown in FIGS. 1–4, the assembly in accordance with the invention also includes a crossbow 30, comprising a bow member 29 and a bow string 31. Bow member 29 is provided with a central substantially circular opening 36 for receiving nose portion 42 and an outwardly disposed fitting or ferrule 35 forwardly extending from opening 36, which fits snugly and rotatably about nose portion 42, as is best shown in FIG. 4. Since nose portion 42 is provided with a flange 43 at its tip (as described previously), ferrule 35 is retained on its forward side about nose portion 42, even during rotational movement of bow member 29, and is retained on its rearward side due to frame 21, which has a diameter greater than that of ferrule 35.

Bow string 31 of crossbow 30 as illustrated in FIGS. 1 and 2, is attached at either end to the ends of bow member 29 along bow grooves 37, and is caught by a hook 39 on cocking member 27.

When operating the assembly of the invention, one of toy darts 33 is selected and inserted into ejection channel 45 of barrel 25. Cocking member 27 is then retracted in order to place spring means in an activated or ready-to-fire position, as previously described. As a result, string 39 of crossbow 30 is stretched tautly due to the rearward flexing under resistance by the two bows of bow member 29. Finally, trigger 23 of gun 17 is pulled, releasing spring means 49 from the activated position and thereby propelling dart 33 out ejection channel 45.

Turning to FIG. 1 once again, the pistol crossbow assembly is shown positioned in a package 11, which typically includes a cardboard back 13 and a transparent plastic cover 15. Plastic cover 15 is substantially square in shape and includes a frame or rim 16 adhesively secured to cardboard back 13 in order to sealingly wrap the assembly in package 11. Since bow member 29 is pivotally connected to nose portion 42, as previously described, bow member 29 lays substantially parallel to the major plane of gun 17 when positioned in package 11. It should be noted that the package 11 is "flat", that is, its depth is about an inch or less.

Figure 3:
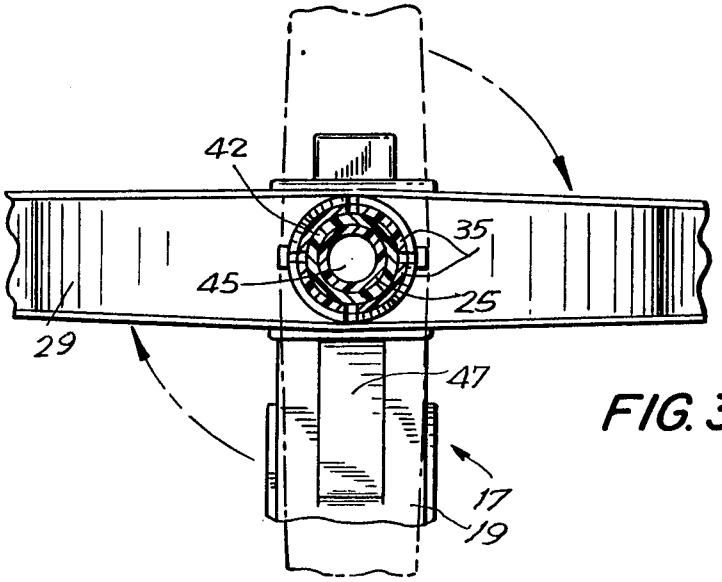
FIG. 3 is a cross-sectional view taken along line 3—3 of FIG. 2.

Before using the assembly of the invention, bow member 29 is rotated approximately 90 degrees about nose portion 42 so that it lays perpendicular to the major plane of the gun assembly 17, as best shown in FIG. 3. This position is suitable for operation of the assembly by the user, as described above. Moreover, since ferrule 35 of bow member 29 is frictionally fit about nose portion 42, bow member 29 does not freely rotate, but rotates only in response to a force applied to bow member 29 by the user.

Although a particular type of pivotal rotation means is shown for rotatably connecting the bow to the nose of the gun, other rotational means may be used so long as they come within the scope of the inventive concept.

It will thus been seen that the objects set forth above, among those made apparent from the preceding description, are efficiently attained and, since certain changes may be made in the above device without departing from the spirit and scope of the invention, it is intended that all matter contained in the above description shall be interpreted as illustrative and not in a limiting sense.

It is also to be understood that the following claims are intended to cover all the generic and specific features of the invention herein described and all statements of the scope of the invention which, as a matter of language, might be said to fall there between.

I claim:

1. A pistol crossbow assembly comprising:

a gun member, said gun member including a frame, a trigger, a handle and a nose portion defining a major plane, said nose portion forwardly extending from said frame and having a longitudinal axis; and a crossbow member, said crossbow member including a bow and a string, the bow being rotatably connected to the nose portion of said gun member to enable pivotal twisting thereabout from a first operative position where said bow and string lie substantially transverse to the major plane of said gun member to a second package position where said bow and string lie substantially along the major plane of said gun member, wherein the assembly further comprises means for preventing movement of said bow along the longitudinal axis of said nose portion.

2. The assembly of claim 1, wherein said bow is rotatable in either a first direction or in a second opposite direction when twisted from said first operative position to said second packaged position.

3. The assembly of claim 1, wherein said box includes a central opening for receiving said nose portion of said gun member.

4. The assembly of claim 3, wherein said bow further includes a fitting member extending from said central opening and rotatably disposed about said nose portion.

5. The assembly of claim 4, wherein said fitting member is frictionally fit about said nose portion.

6. The assembly of claim 4, wherein said nose portion includes a pair of flange members for retaining said fitting about said nose portion.

7. The assembly of claim 1, wherein said movement preventing means comprises a rearwardly disposed shoulder defined by said gun member frame and a forwardly extending fitting member.

8. A piston crossbow assembly and package combination, the combination comprising:

a pistol crossbow assembly, said assembly including a gun member having a frame, a trigger, a handle and a nose region defining a major plane, said nose region having a longitudinal axis, a crossbow member having a bow and string, the bow being rotatably connected to the nose region of said gun member to enable pivotal twisting thereabout, wherein said assembly further includes means for preventing movement of said bow along the longitudinal axis of said nose region; and a substantially flat package for receiving and containing said assembly, said bow of said crossbow member lying substantially along the major plane of said gun member when positioned in said package.

9. A method for reducing the packaging size of a pistol crossbow assembly, the assembly including a gun member having a frame, a trigger, a handle and a nose member defining a major plane, said nose member having a longitudinal axis and having a bow and a string, the bow being rotatably connected to the nose portion of said gun, the method comprising pivotally twisting the bow from a first operative position where the bow and string lie substantially transverse to the major plane of the gun member to a second packaging position where the bow and string lie substantially along the major plane of the gun member without moving said bow along the longitudinal axis of said nose member.

* * * * *